US012529228B2

(12) United States Patent
Andrews et al.

(10) Patent No.: US 12,529,228 B2
(45) Date of Patent: Jan. 20, 2026

(54) FLUE PROTECTOR SYSTEM

(71) Applicants: Eric Andrews, Temecula, CA (US); Francisco Hernandez, Aliso Viejo, CA (US)

(72) Inventors: Eric Andrews, Temecula, CA (US); Francisco Hernandez, Aliso Viejo, CA (US)

( * ) Notice: Subject to any disclaimer, the term of this patent is extended or adjusted under 35 U.S.C. 154(b) by 218 days.

(21) Appl. No.: 18/102,479

(22) Filed: Jan. 27, 2023

(65) Prior Publication Data

US 2024/0254772 A1 Aug. 1, 2024

(51) Int. Cl.
*E04D 13/14* (2006.01)

(52) U.S. Cl.
CPC ..... *E04D 13/14* (2013.01)

(58) Field of Classification Search
CPC ..... E04D 13/14
USPC ..... 52/736.4, 736.3, 738.1
See application file for complete search history.

(56) References Cited

U.S. PATENT DOCUMENTS 71,207 A * 11/1867 Olhaber ..... E04D 13/14 122/20 B
428,245 A * 5/1890 Erdman ..... E04D 13/14 126/364.1
556,285 A * 3/1896 Schlicht ..... F23L 15/04 110/304
731,531 A * 6/1903 Asling ..... E04D 13/14 126/364.1
983,680 A * 2/1911 Butcher ..... E04D 13/14 126/364.1
1,226,516 A * 5/1917 Hill ..... E04D 13/14 126/364.1
3,672,626 A * 6/1972 Thornton ..... E04G 11/12 249/48
5,857,542 A * 1/1999 Mason ..... E06C 7/08 182/92
6,079,165 A * 6/2000 Bingel, III ..... E04H 12/2292 52/170
6,234,314 B1 * 5/2001 Qiu ..... B65D 5/5033 206/320
7,070,021 B1 * 7/2006 McKinney ..... A47B 96/00 182/92
7,415,808 B2 * 8/2008 Bingel, III ..... E04G 23/0225 52/170
7,770,861 B2 * 8/2010 Huxtable ..... A47B 95/043 248/345.1
8,813,421 B2 * 8/2014 Schaeffer ..... A01G 17/06 47/46
9,307,848 B2 * 4/2016 Bernstein ..... A47F 5/04
9,414,677 B2 * 8/2016 Sahm, III ..... B65G 1/02
9,737,143 B2 * 8/2017 Ramon ..... B65G 1/02
9,986,831 B2 * 6/2018 Smith ..... F16F 1/44
2005/0005565 A1 * 1/2005 McSharry ..... E04F 19/026 52/716.5
2007/0170137 A1 * 7/2007 Thelwell ..... E01F 15/0469 211/183

(Continued)

*Primary Examiner* — Basil S Katcheves
(74) *Attorney, Agent, or Firm* — John D. Tran; Rhema Law Group

(57) ABSTRACT

A flue protector system and methods of manufacture can include: forming an attachment plate including a tab configured to fix the attachment plate to an upright column without the use of a tool; and forming a bumper extended from the attachment plate, the bumper defines a flue space extending to the upright column.

5 Claims, 9 Drawing Sheets

(56) References Cited

U.S. PATENT DOCUMENTS

| | | | | |
|---|---|---|---|---|
| 2008/0029676 | A1* | 2/2008 | Huxtable | F16F 7/00<br>248/345.1 |
| 2014/0196997 | A1* | 7/2014 | Michael | E01F 15/141<br>188/377 |
| 2016/0235202 | A1* | 8/2016 | Ramon | A47B 95/043 |

* cited by examiner

FLUE PROTECTOR SYSTEM

TECHNICAL FIELD

This disclosure relates to storage systems, more particularly to defining protected flue space within storage systems.

BACKGROUND

Warehouse storage systems comprising vertical storage racks are required to utilize and implement flue space. Flue space is clear vertical lines of sight within storage racks and is recognized in two types: longitudinal flue space and traverse flue space.

When implemented, illustratively as a pallet storage rack, the longitudinal flue space can be the space between back-to-back pallets perpendicular to the direction of loading. The transverse flue space can be the space between side-by-side pallets parallel to the direction of loading.

Systems and methods for defining protected flue space within storage systems compete in a highly contested market with competitive pressures unique to large storage systems. As these systems can fill warehouses, cost, installation time, and installation complexity are chief concerns as many hundreds or even thousands of individual elements may be needed for an individual installation.

That is, to protect flue space a physical flue protector may need to be mounted to each upright column in a storage rack, and storage racks may have thousands of upright columns. Prior developments in flue space protection only provided partial solutions.

One prior development includes the protection of flue space through warehouse processes and employee training. This prior development fails in most cases due to high turnover of warehouse employees, poor and expensive training of warehouse employees, and requirements on warehouse employees to work at high speed and high volume. The many short comings of this prior development has lead to worse fires and is the major reason most warehouses require physical means of protecting the flue space.

Another prior development offered physical means of protecting the flue space with a full length bar which attaches to a front upright column and a rear upright column and defining flue space therebetween. This full length bar is very costly in terms of the bar itself as well as installation requirements.

Firstly, the bar extends the full width of the storage structure making the material costs large. Furthermore, installation requires shelves to be emptied making retrofits more difficult and require more labor time.

Installation also requires the use of tools and special construction hardware. As such, the full length bar provided a solution that is difficult and expensive to implement.

Solutions have been long sought but prior developments have not taught or suggested any complete solutions, and solutions to these problems have long eluded those skilled in the art. Thus there remains a considerable need for devices and methods that can protect flue space while being easy to install, inexpensive, and requiring no tools.

SUMMARY

A flue protector system and methods of manufacturing are disclosed. The flue protector is easy to install, inexpensive, and requires no tools.

The flue protector system and methods of manufacture can include: forming an attachment plate including a tab configured to fix the attachment plate to an upright column without the use of a tool; and forming a bumper extended from the attachment plate, the bumper defines a flue space extending to the upright column.

Other contemplated embodiments can include objects, features, aspects, and advantages in addition to or in place of those mentioned above. These objects, features, aspects, and advantages of the embodiments will become more apparent from the following detailed description, along with the accompanying drawings.

BRIEF DESCRIPTION OF THE DRAWINGS

The flue protector is illustrated in the figures of the accompanying drawings which are meant to be exemplary and not limiting, in which like reference numerals are intended to refer to like components, and in which.

DETAILED DESCRIPTION

Figure 1:
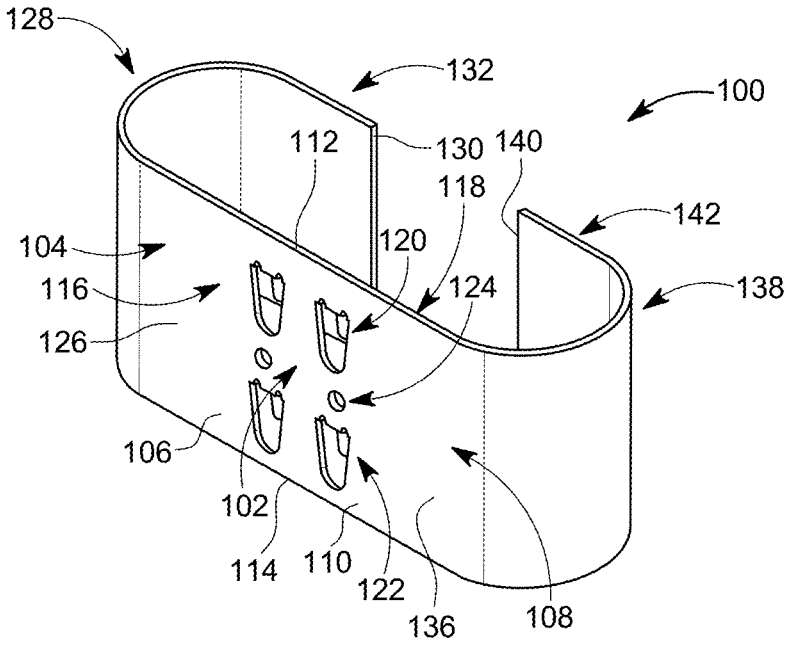
FIG. 1 is an isometric view of the flue protector in a first embodiment.

In the following description, reference is made to the accompanying drawings that form a part hereof, and in which are shown by way of illustration, embodiments in which the flue protector may be practiced. It is to be understood that other embodiments may be utilized and structural changes may be made without departing from the scope of the flue protector.

When features, aspects, or embodiments of the flue protector are described in terms of steps of a process, an operation, a control flow, or a flow chart, it is to be understood that the steps can be combined, performed in a different order, deleted, or include additional steps without departing from the flue protector as described herein.

The flue protector is described in sufficient detail to enable those skilled in the art to make and use the flue protector and provide numerous specific details to give a thorough understanding of the flue protector; however, it will be apparent that the flue protector may be practiced without these specific details.

In order to avoid obscuring the flue protector, some well-known system configurations and descriptions are not disclosed in detail. Likewise, the drawings showing embodiments of the system are semi-diagrammatic and not to scale and, particularly, some of the dimensions are for the clarity of presentation and are shown greatly exaggerated in the drawing FIGs.

For expository purposes, the term "horizontal" as used herein is defined as a plane parallel to the top plane or surface of the flue protector, regardless of its orientation. The term "vertical" refers to a direction perpendicular to the horizontal as just defined. Terms, such as "above", "below", "bottom", "top", "side", "higher", "lower", "upper", "over", and "under", are defined with respect to the horizontal plane. As used herein, the term "couple" as in "coupling" or "coupled" means a direct or indirect contact between elements.

Referring now to FIG. 1, therein is shown an isometric view of the flue protector 100 in a first embodiment. The flue protector 100 is depicted having an attachment plate 102, a first bumper 104 extending from a left side 106 of the attachment plate, and a second bumper 108 extending from a right side 110 of the attachment plate 102.

The attachment plate 102, the first bumper 104, and the second bumper 108 can be integrally formed from a durable steel plate, plastic, or a combination thereof. The flue protector 100 can include a top surface 112 and a bottom surface 114, which are depicted as parallel surfaces.

Extending between the top surface 112 and the bottom surface 114, the flue protector 100 can include an exterior surface 116 and an interior surface 118. The interior surface 118 can be the surface between the first bumper 104 and the second bumper 108, the surface between the second bumper 108 and the attachment plate 102, and the surface between the first bumper 104 and the attachment plate 102.

The exterior surface 116 can extend across the attachment plate 102, the first bumper 104, and the second bumper 108. The exterior surface 116 further covers an outer surface of the flue protector 100 from a front of the flue protector 100 to a back of the flue protector 100.

Figure 2:
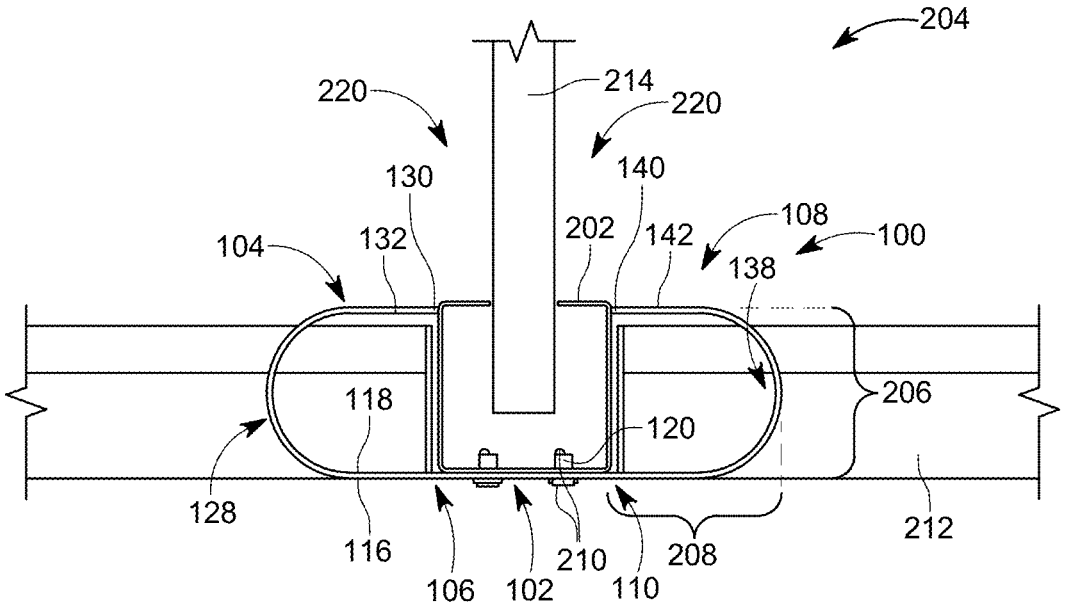
FIG. 2 is a top view of the flue protector of FIG. 1 fixed to an upright column of a storage rack.

The attachment plate 102 is depicted to have mounting tabs and securing pinholes, each of which fix the attachment plate 102 tightly to the upright column 202 of FIG. 2, ensuring the flue protector 100 is not bent or distorted. More particularly, the attachment plate 102 can include top tabs 120 and bottom tabs 122 with pinholes 124 therebetween.

The top tabs 120 can be arranged in a row with one of the top tabs 120 near the left side 106 of the attachment plate 102 and the other top tab 120 near the right side 110 of the attachment plate 102. Similarly, the bottom tabs 122 can be arranged in a row with one of the bottom tabs 122 near the left side 106 of the attachment plate 102 and the other bottom tab 122 near the right side 110 of the attachment plate 102.

The pinholes 124 can be positioned vertically in line with the tabs. That is, one of the pinholes 124 could be between and inline with the top tab 120 on the right side 110 and the bottom tab 122 on the right side 110 while the other pinhole 124 could be between and inline with the top tab 120 on the left side 106 and the bottom tab 122 on the left side 106.

The tabs themselves can be formed to extend inward from the exterior surface 116 and past the interior surface 118 of the attachment plate 102. The tabs can couple with tab-holes (not shown) in the upright columns 202 of storage racks 204, both of FIG. 2.

The tabs can fix the attachment plate 102 to the upright columns 202 of storage racks 204 without the use of tools. The pinholes 124 within the attachment plate 102 are configured align with rack pinholes (not shown) to fix the attachment plate 102 to the upright column 202 with the use of the j-type drop pins 210 of FIG. 2.

The first bumper 104 can extend out away from the left side 106 of the attachment plate 102 with a first bumper front extension 126, transition to a first bumper rounded end 128, and terminate at a first bumper terminal surface 130 at the end of a first bumper back extension 132.

The second bumper 108 can extend out away from the right side 110 of the attachment plate 102 with a second bumper front extension 136, transition to a second bumper rounded end 138, and terminate at a second bumper terminal surface 140 at the end of a second bumper back extension 142.

The first bumper front extension 126 and the first bumper back extension 132 can be the same size. Similarly, the second bumper front extension 136 and the second bumper back extension 142 can be the same size.

The first bumper rounded end 128 and the second bumper rounded end 138 can avoid any catch points and allow a pallet to slide against the first bumper 104 and the second bumper 108 as a guide. The first bumper terminal surface 130 and the second bumper terminal surface 140 can face each other and in one contemplated embodiment, are three inches apart to allow for the upright column 202 to fit therebetween.

The first bumper 104 and the second bumper 108 can extend from opposite sides of the attachment plate 102 and can define the flue space 220 of FIG. 2. The flue space 220 is clear vertical lines of sight within the storage racks 204.

The flue space 220 defined by both the first bumper 104 and the second bumper 108 can be transverse flue space 220 parallel to the direction of loading and perpendicular to the attachment plate 102. The flue space 220 can extend from the termination of the first bumper rounded end 128 to the first bumper terminal surface 130 or further to the upright column 202 or even to the upright horizontal strut 214 of FIG. 2. The flue space 220 can also extend from the termination of the second bumper rounded end 138 to the second bumper terminal surface 140 or further to the upright column 202 or even to the upright horizontal strut 214.

As such, the flue protector 100 provides the physical means of protection in the transverse flue space by installing the flue protector 100 on the front upright column 202 of the storage rack 204. The flue protector 100 can guide pallets onto the shelf while simultaneously provide three inches of flue space 220 on both sides of the upright column 202.

Flue protection requires only a single flue protector 100 and can be installed easily without tools. Costs are reduced both by reducing installation and labor costs as well as with a massive reduction in the amount of material used in the flue protector 100.

The flue protector 100 uses significantly less material than systems that span the full length of the flue space 220 between upright columns since the flue protector 100 only is attached to a single column.

Referring now to FIG. 2, therein is shown a top view of the flue protector 100 of FIG. 1 fixed to an upright column 202 of a storage rack 204. The storage rack 204 can be any rack structure including racks to hold pallets, boxes, or other containers.

It is contemplated that the storage rack 204 could be scaled from a smaller personal installation to a large multi-warehouse installation. The flue protector 100 is shown with a depth 206, which can be the thickness of a bumper, either the first bumper 104 or the second bumper 108.

The depth 206 can be measured between the exterior surface 116 of a bumper front extension and the exterior surface 116 of a bumper back extension. The depth 206 can be three inches for most pallet storage racks.

As will be appreciated, the upright column 202 is also three inches in depth, with a three-by-three inch cross-section. The first bumper 104 and the second bumper 108 do not align exactly with the back surface of the upright column 202 due to the interior surface 118 of the attachment plate 102 being in direct contact with the upright column 202.

Rather the second bumper back extension 142 and the first bumper back extension 132 are the thickness of the attachment plate 102 from an exact alignment with the upright column 202. The flue protector 100 can further include a bumper width 208, which can be the distance from the attachment plate 102 to a bumper rounded end.

That is, the bumper width 208 can be the distance from the right side 110 of the attachment plate 102 to the second bumper rounded end 138 and can also be the distance from the left side 106 of the attachment plate 102 to the first bumper rounded end 128. Alternatively, the bumper width 208 could be the distance between the first bumper terminal surface 130 and the first bumper rounded end 128, and can be the distance between the second bumper terminal surface 140 and the second bumper rounded end 138. In the disclosed flue protector 100 the bumper width 208 can be three inches.

The first bumper terminal surface 130 and the second bumper terminal surface 140 can be in direct contact with the upright column 202 when installed. The top tabs 120 are shown extending from the attachment plate 102 through the upright column 202.

To further secure the flue protector 100 to the upright column 202, j-type drop pins 210 are shown inserted through the pinholes 124 of FIG. 1 and through corresponding holes in the upright column 202. The j-type drop pins 210 rigidly affix the flue protector 100 to the upright column 202 of the storage rack 204.

The top tabs 120, the bottom tabs 122 of FIG. 1, and the j-type drop pins 210 can be used without tools in a matter of seconds per mount. This has been discovered to be a large improvement over prior developments requiring multiple minutes to mount with tools. Furthermore, the flue protector 100 can be mounted to the upright column 202 without unloading the storage rack 204 while prior developments did require the storage rack 204 to be unloaded as prior developments spanned between upright columns.

The storage rack 204 can further include a rack beam 212 running perpendicular to the upright column 202. The storage rack 204 can span the horizontal widths of the storage rack 204 and be vertically between storage areas. The rack beam 212 can be three inches in depth.

Perpendicular to both the rack beam and the upright column 202 is an upright horizontal strut 214. The upright horizontal strut 214 can run vertically within the storage rack 204 and be positioned horizontally between storage areas.

The flue protector 100 can define a flue space 220 within the storage rack 204. The flue space 220 is clear vertical lines of sight within the storage racks 204.

The flue space 220 can extend from the termination of the first bumper rounded end 128 to the first bumper terminal surface 130 or further to the upright column 202 or even to the upright horizontal strut 214. The flue space 220 can also extend from the termination of the second bumper rounded end 138 to the second bumper terminal surface 140 or further to the upright column 202 or even to the upright horizontal strut 214.

Figure 3:
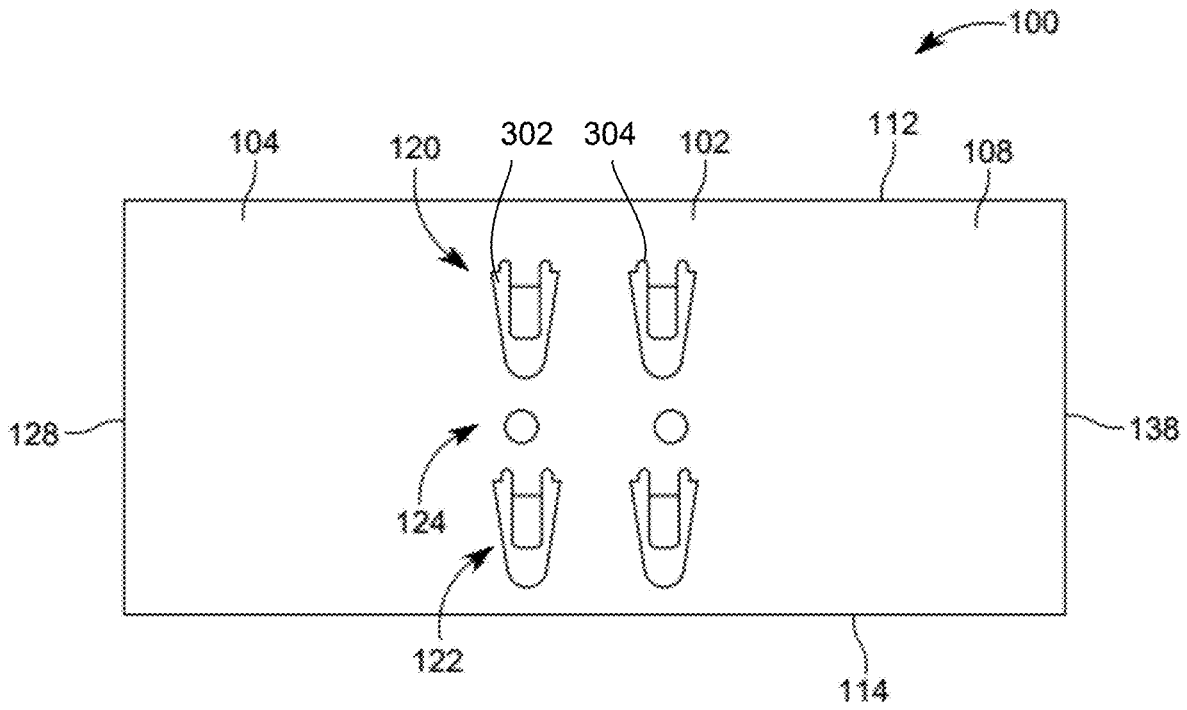
FIG. 3 is a front view of the flue protector of FIG. 1.

Referring now to FIG. 3, therein is shown a front view of the flue protector 100 of FIG. 1. The flue protector 100 can have a total width of nine inches from the first bumper rounded end 128 to the second bumper rounded end 138.

The flue protector 100 can have a total height of four inches from the top surface 112 to the bottom surface 114. Between the first bumper 104 and the second bumper 108, the flue protector 100 is shown with the attachment plate 102 having the top tabs 120, the bottom tabs 122, and the pinholes 124 therebetween. The top tabs 120 are depicted extending from the attachment plate 102 and having a cutout 302 between the attachment plate 102 and the top tab 120. The cutout 302 is shaped by round, semicircular, connections 304 extending through the attachment plate 102 and the round connections 304 positioned laterally between the top tabs 120 and the attachment plate 102 and the round connections 304 extending laterally away from the top tab 120 on two sides of the top tab 120.

Figure 4:
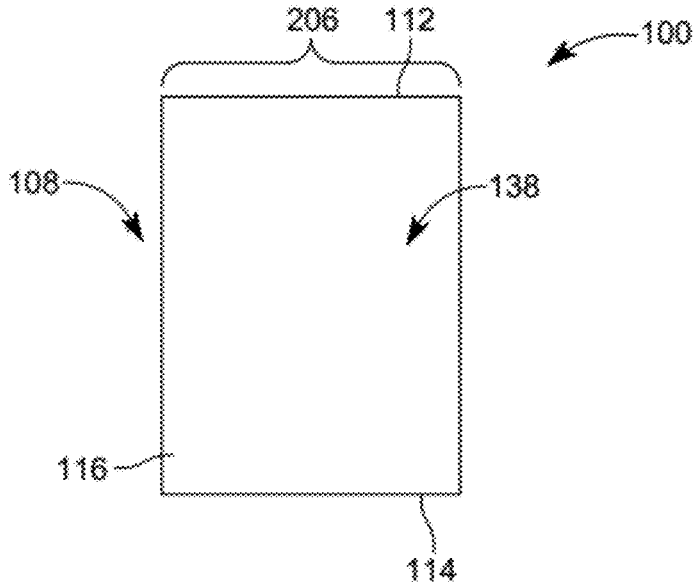
FIG. 4 is a right-side view of the flue protector of FIG. 1.

Referring now to FIG. 4, therein is shown a right-side view of the flue protector 100 of FIG. 1. The exterior surface 116 is shown defining the second bumper 108 with the second bumper rounded end 138. The second bumper 108 is depicted having the depth 206 of three inches and a height of four inches between the top surface 112 and the bottom surface 114.

Figure 5:
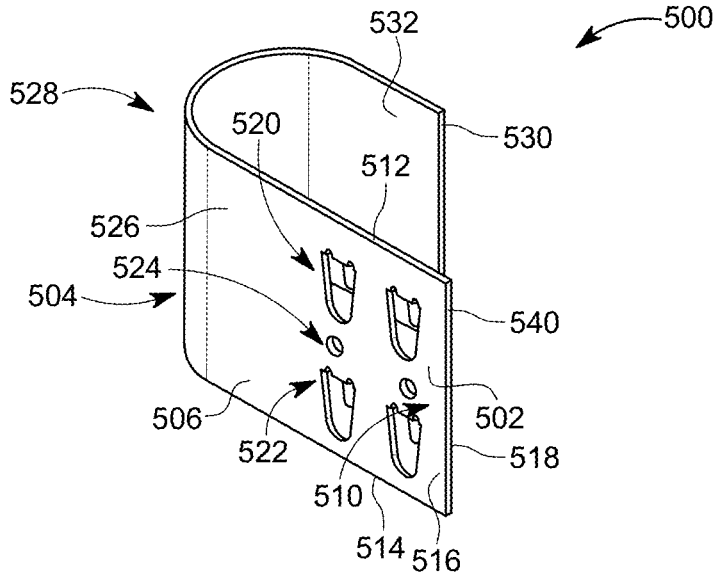
FIG. 5 is an isometric view of the flue protector in a second embodiment.

Referring now to FIG. 5, therein is shown an isometric view of the flue protector 500 in a second embodiment. The flue protector 500 is depicted having an attachment plate 502 and a bumper 504 extending from a left side 506 of the attachment plate 502. A right side 510 of the attachment plate 502 does not include a bumper and can be used for the upright column 202 on the end of the storage rack 204, both of FIG. 2.

The attachment plate 502 and the bumper 504 can be integrally formed from a durable steel plate, plastic, or a combination thereof. The flue protector 500 can include a top surface 512 and a bottom surface 514, which are depicted as parallel surfaces.

Extending between the top surface 512 and the bottom surface 514, the flue protector 500 can include an exterior surface 516 and an interior surface 518. The interior surface 518 can be the surface between the bumper 504 and the attachment plate 502.

The exterior surface 516 can extend across the attachment plate 502 and the bumper 504. The exterior surface 516 further covers an outer surface of the flue protector 500 from a front of the flue protector 500 to a back of the flue protector 500.

The attachment plate 502 is depicted to have mounting tabs and securing pinholes, each of which fix the attachment plate 502 tightly to the upright column 202, ensuring the flue protector 500 is not bent or distorted. More particularly, the attachment plate 502 can include top tabs 520 and bottom tabs 522 with pinholes 524 therebetween.

The top tabs 520 can be arranged in a row with one of the top tabs 520 near the left side 506 of the attachment plate 502 and the other top tab 520 near the right side 510 of the attachment plate 502. Similarly, the bottom tabs 522 can be arranged in a row with one of the bottom tabs 522 near the left side 506 of the attachment plate 502 and the other bottom tab 522 near the right side 510 of the attachment plate 502.

The pinholes 524 can be positioned vertically in line with the tabs. That is, one of the pinholes 524 could be between and inline with the top tab 520 on the right side 510 and the bottom tab 522 on the right side 510 while the other pinhole 524 could be between and inline with the top tab 520 on the left side 506 and the bottom tab 522 on the left side 506.

The tabs themselves can be formed to extend inward from the exterior surface 516 and past the interior surface 518 of the attachment plate 502. The tabs can couple with tab-holes (not shown) in the upright columns 202 of storage racks 204.

The tabs can fix the attachment plate 502 to the upright columns 202 of storage racks 204 without the use of tools. The pinholes 524 within the attachment plate 502 are configured align with rack pinholes (not shown) to fix the attachment plate 502 to the upright column 202 with the use of the j-type drop pins 210 of FIG. 2.

The bumper 504 can extend out away from the left side 506 of the attachment plate 502 with a bumper front extension 526, transition to a bumper rounded end 528, and terminate at a bumper terminal surface 530 at the end of a bumper back extension 532. The right side 510 of the attachment plate 502 can terminate at an attachment plate terminal surface 540.

The bumper front extension 526 and the bumper back extension 532 can be the same size. The bumper rounded end 528 can avoid any catch points and allow a pallet to slide against the bumper 504 as a guide. The bumper terminal surface 530 and the attachment plate terminal surface 540 can face in the same direction, which is right.

The bumper 504 can extend from the left side 506 of the attachment plate 502 and can define the flue space 220 of FIG. 2. The flue space 220 is clear vertical lines of sight within the storage racks 204.

The flue space 220 defined by the bumper 504 can be transverse flue space 220 parallel to the direction of loading and perpendicular to the attachment plate 502. The flue space 220 can extend from the termination of the bumper rounded end 528 to the bumper terminal surface 530 or further to the upright column 202 or even to the upright horizontal strut 214 of FIG. 2.

As such, the flue protector 500 provides the physical means of protection in the transverse flue space by installing the flue protector 500 on the front upright column 202 of the storage rack 204. The flue protector 500 can guide pallets onto the shelf while simultaneously provide three inches of flue space 220 on one side of the upright column 202.

Flue protection requires only a single flue protector 500 and can be installed easily without tools. Costs are reduced both by reducing installation and labor costs as well as with a massive reduction in the amount of material used in the flue protector 500.

The flue protector 500 uses significantly less material than systems that span the full length of the flue space 220 between upright columns since the flue protector 500 only is attached to a single column.

Figure 6:
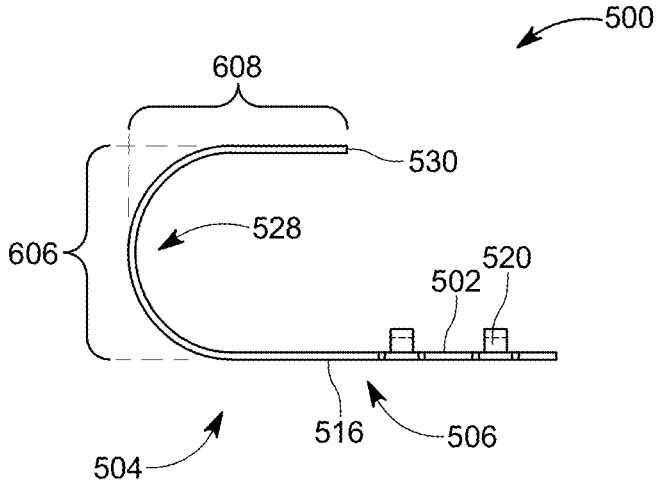
FIG. 6 is a top view of the flue protector of FIG. 5.

Referring now to FIG. 6, therein is shown a top view of the flue protector 500 of FIG. 5. The flue protector 500 is shown with a depth 606, which can be the thickness of the bumper 504.

The depth 606 can be measured between the exterior surface 516 of a bumper front extension and the exterior surface 516 of a bumper back extension. The depth 606 can be three inches for most pallet storage racks.

The flue protector 500 can further include a bumper width 608, which can be the distance from the attachment plate 502 to a bumper rounded end. That is, the bumper width 608 can be the distance from the left side 506 of the attachment plate 502 to the bumper rounded end 528. Alternatively, the bumper width 608 could be the distance between the bumper terminal surface 530 and the bumper rounded end 528. In the disclosed flue protector 500 the bumper width 608 can be three inches.

The bumper terminal surface 530 can be mounted in direct contact with the upright column 202 of FIG. 2. The top tabs 520 are shown extending from the attachment plate 502.

The top tabs 520, the bottom tabs 522 of FIG. 5, and the j-type drop pins 210 of FIG. 2 can be used without tools in a matter of seconds per mount. This has been discovered to be a large improvement over prior developments requiring multiple minutes to mount with tools. Furthermore, the flue protector 500 can be mounted to the upright column 202 without unloading the storage rack 204 of FIG. 2 while prior developments did require the storage rack 204 to be unloaded as prior developments spanned between upright columns.

Figure 7:
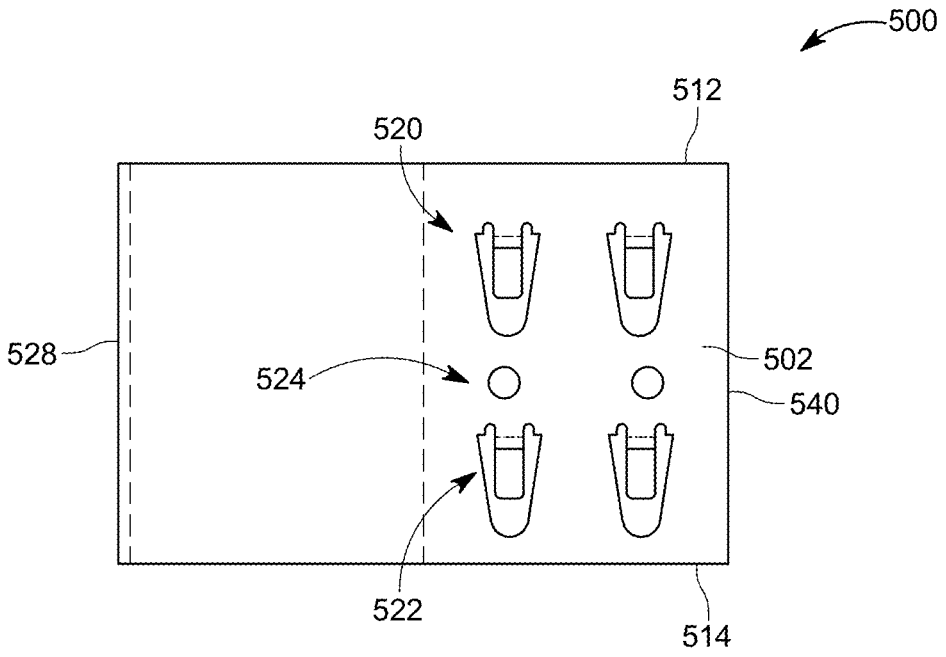
FIG. 7 is a front view of the flue protector of FIG. 5.

Referring now to FIG. 7, therein is shown a front view of the flue protector 500 of FIG. 5. The flue protector 500 can have a total width of six inches from the bumper rounded end 528 to the attachment plate terminal surface 540.

The flue protector 500 can have a total height of four inches from the top surface 512 to the bottom surface 514. The attachment plate 502 is depicted having the top tabs 520, the bottom tabs 522, and the pinholes 524 therebetween.

Figure 8:
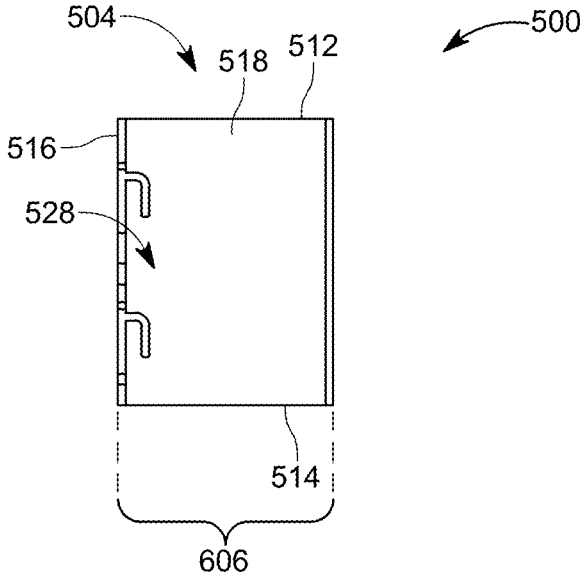
FIG. 8 is a right-side view of the flue protector of FIG. 5.

Referring now to FIG. 8, therein is shown a right-side view of the flue protector 500 of FIG. 5. The interior surface 518 is shown defining the bumper 504 and the inner surface of the bumper rounded end 528 between the exterior surface 516. The bumper 504 is depicted having the depth 606 of three inches and a height of four inches between the top surface 512 and the bottom surface 514.

Figure 9:
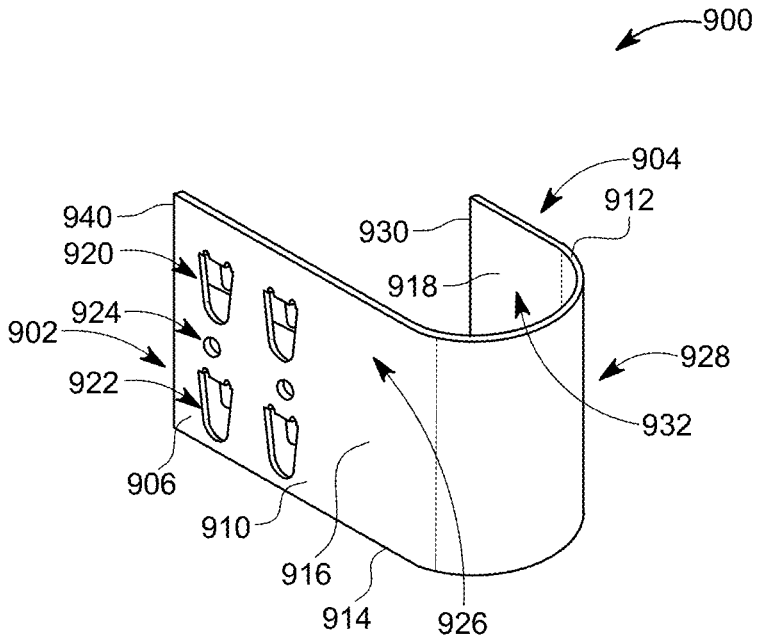
FIG. 9 is an isometric view of the flue protector in a third embodiment.

Referring now to FIG. 9, therein is shown an isometric view of the flue protector 900 in a third embodiment. The flue protector 900 is depicted having an attachment plate 902 coupled to a bumper 904.

The flue protector 900 can terminate at a left side 906 of the attachment plate 902 without having a bumper, which can be used for the upright column 202 on the end of the storage rack 204, both of FIG. 2. The bumper 904 can extend from the right side 910 of the attachment plate 902.

The attachment plate 902 and the bumper 904 can be integrally formed from a durable steel plate, plastic, or a combination thereof. The flue protector 900 can include a top surface 912 and a bottom surface 914, which are depicted as parallel surfaces.

Extending between the top surface 912 and the bottom surface 914, the flue protector 900 can include an exterior surface 916 and an interior surface 918. The interior surface 918 can be the surface between the bumper 904 and the attachment plate 902.

The exterior surface 916 can extend across the attachment plate 902 and the bumper 904. The exterior surface 916 further covers an outer surface of the flue protector 900 from a front of the flue protector 900 to a back of the flue protector 900.

The attachment plate 902 is depicted to have mounting tabs and securing pinholes, each of which fix the attachment plate 902 tightly to the upright column 202, ensuring the flue protector 900 is not bent or distorted. More particularly, the attachment plate 902 can include top tabs 920 and bottom tabs 922 with pinholes 924 therebetween.

The top tabs 920 can be arranged in a row with one of the top tabs 920 near the left side 906 of the attachment plate 902 and the other top tab 920 near the right side 910 of the attachment plate 902. Similarly, the bottom tabs 922 can be arranged in a row with one of the bottom tabs 922 near the left side 906 of the attachment plate 902 and the other bottom tab 922 near the right side 910 of the attachment plate 902.

The pinholes 924 can be positioned vertically in line with the tabs. That is, one of the pinholes 924 could be between and inline with the top tab 920 on the right side 910 and the bottom tab 922 on the right side 910 while the other pinhole 924 could be between and inline with the top tab 920 on the left side 906 and the bottom tab 922 on the left side 906.

The tabs themselves can be formed to extend inward from the exterior surface 916 and past the interior surface 918 of the attachment plate 902. The tabs can couple with tab-holes (not shown) in the upright columns 202 of storage racks 204.

The tabs can fix the attachment plate 902 to the upright columns 202 of storage racks 204 without the use of tools. The pinholes 924 within the attachment plate 902 are configured align with rack pinholes (not shown) to fix the attachment plate 902 to the upright column 202 with the use of the j-type drop pins 210 of FIG. 2.

The bumper 904 can extend out away from the right side 910 of the attachment plate 902 with a bumper front extension 926, transition to a bumper rounded end 928, and terminate at a bumper terminal surface 930 at the end of a bumper back extension 932. The right side 910 of the attachment plate 902 can terminate at an attachment plate terminal surface 940.

The bumper front extension 926 and the bumper back extension 932 can be the same size. The bumper rounded end 928 can avoid any catch points and allow a pallet to slide against the bumper 904 as a guide. The bumper terminal surface 930 and the attachment plate terminal surface 940 can face in the same direction, which is left.

The bumper 904 can extend from the right side 910 of the attachment plate 902 and can define the flue space 220 of FIG. 2. The flue space 220 is clear vertical lines of sight within the storage racks 204.

The flue space 220 defined by the bumper 904 can be transverse flue space 220 parallel to the direction of loading and perpendicular to the attachment plate 902. The flue space 220 can extend from the termination of the bumper rounded end 928 to the bumper terminal surface 930 or further to the upright column 202 or even to the upright horizontal strut 214 of FIG. 2.

As such, the flue protector 900 provides the physical means of protection in the transverse flue space by installing the flue protector 900 on the front upright column 202 of the storage rack 204. The flue protector 900 can guide pallets onto the shelf while simultaneously provide three inches of flue space 220 on one side of the upright column 202.

Flue protection requires only a single flue protector 900 and can be installed easily without tools. Costs are reduced both by reducing installation and labor costs as well as with a massive reduction in the amount of material used in the flue protector 900.

The flue protector 900 uses significantly less material than systems that span the full length of the flue space 220 between upright columns since the flue protector 900 only is attached to a single column.

Figure 10:
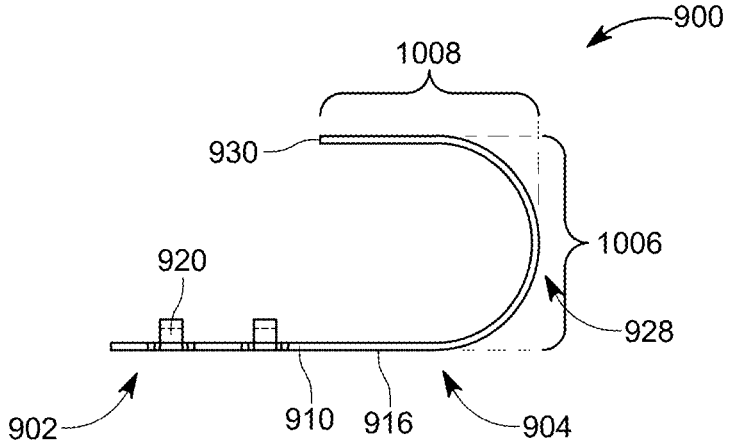
FIG. 10 is a top view of the flue protector of FIG. 9.

Referring now to FIG. 10, therein is shown a top view of the flue protector 900 of FIG. 9. The flue protector 900 is shown with a depth 1006, which can be the thickness of the bumper 904.

The depth 1006 can be measured between the exterior surface 916 of a bumper front extension and the exterior surface 916 of a bumper back extension. The depth 1006 can be three inches for most pallet storage racks.

The flue protector 900 can further include a bumper width 1008, which can be the distance from the attachment plate 902 to a bumper rounded end. That is, the bumper width 1008 can be the distance from the right side 910 of the attachment plate 902 to the bumper rounded end 928. Alternatively, the bumper width 1008 could be the distance between the bumper terminal surface 930 and the bumper rounded end 928. In the disclosed flue protector 900 the bumper width 1008 can be three inches.

The bumper terminal surface 930 can be mounted in direct contact with the upright column 202 of FIG. 2. The top tabs 920 are shown extending from the attachment plate 902.

The top tabs 920, the bottom tabs 922 of FIG. 9, and the j-type drop pins 210 of FIG. 2 can be used without tools in a matter of seconds per mount. This has been discovered to be a large improvement over prior developments requiring multiple minutes to mount with tools. Furthermore, the flue protector 900 can be mounted to the upright column 202 without unloading the storage rack 204 of FIG. 2 while prior developments did require the storage rack 204 to be unloaded as prior developments spanned between upright columns.

Figure 11:
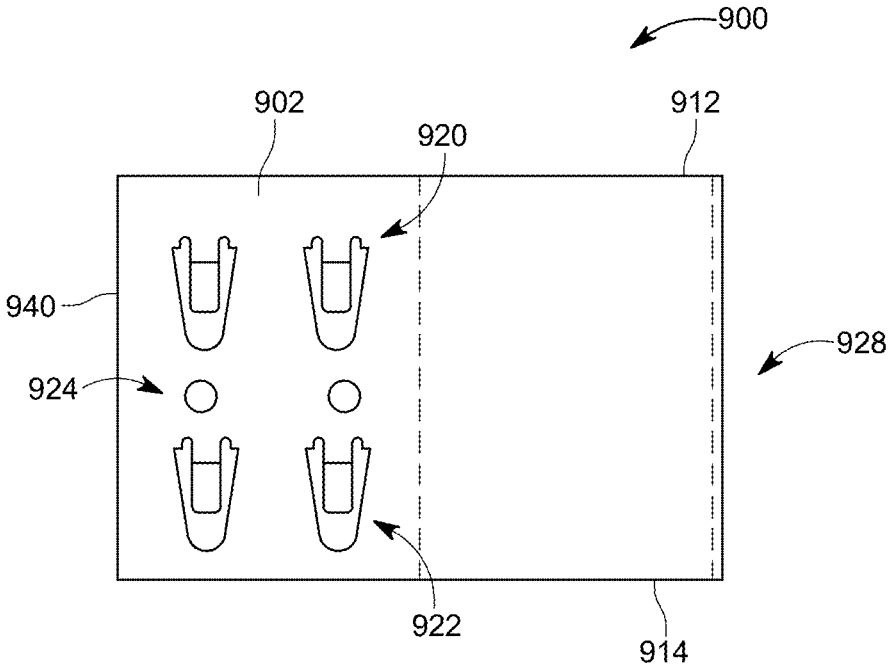
FIG. 11 is a front view of the flue protector of FIG. 9.

Referring now to FIG. 11, therein is shown a front view of the flue protector 900 of FIG. 9. The flue protector 900 can have a total width of six inches from the bumper rounded end 928 to the attachment plate terminal surface 940.

The flue protector 900 can have a total height of four inches from the top surface 912 to the bottom surface 914. The attachment plate 902 is depicted having the top tabs 920, the bottom tabs 922, and the pinholes 924 therebetween.

Figure 12:
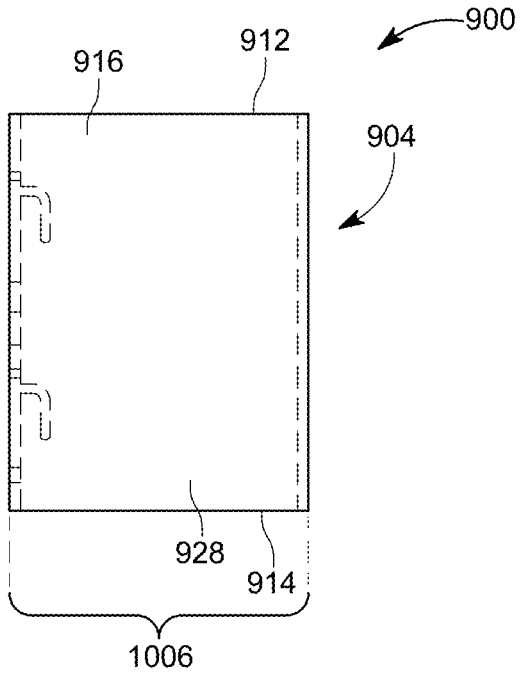
FIG. 12 is a right-side view of the flue protector of FIG. 9.

Referring now to FIG. 12, therein is shown a right-side view of the flue protector 900 of FIG. 9. The exterior surface 916 is shown defining the bumper 904 with the bumper rounded end 928. The bumper 904 is depicted having the depth 1006 of three inches and a height of four inches between the top surface 912 and the bottom surface 914.

Figure 13:
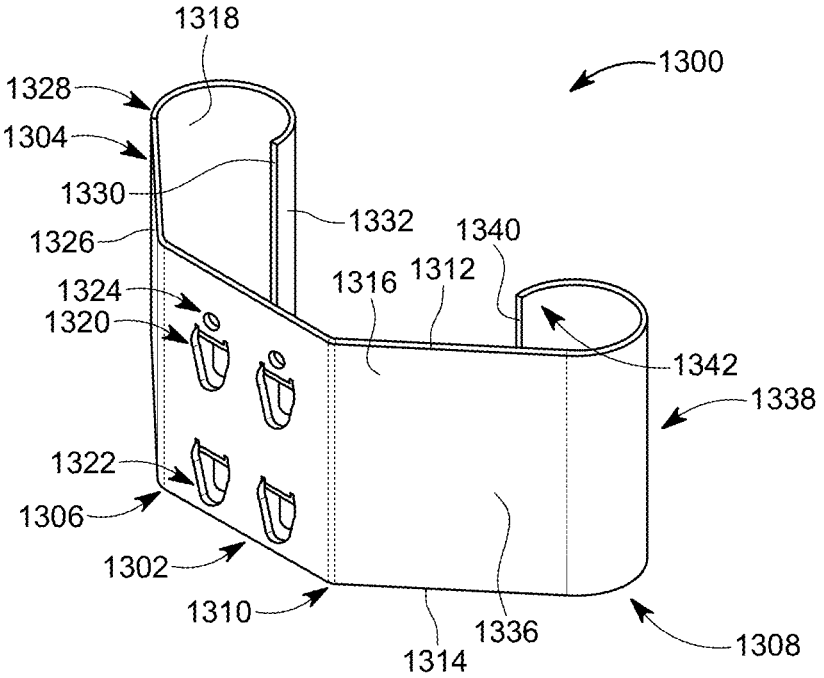
FIG. 13 is an isometric view of the flue protector in a fourth embodiment.

Referring now to FIG. 13, therein is shown an isometric view of the flue protector 1300 in a fourth embodiment. The flue protector 1300 is depicted having an attachment plate 1302, a first bumper 1304 extending from a left side 1306 of the attachment plate, and a second bumper 1308 extending from a right side 1310 of the attachment plate 1302.

The attachment plate 1302, the first bumper 1304, and the second bumper 1308 can be integrally formed from a durable steel plate, plastic, or a combination thereof. The flue protector 1300 can include a top surface 1312 and a bottom surface 1314, which are depicted as parallel surfaces.

Extending between the top surface 1312 and the bottom surface 1314, the flue protector 1300 can include an exterior surface 1316 and an interior surface 1318. The interior surface 1318 can be the surface between the first bumper 1304 and the second bumper 1308, the surface between the second bumper 1308 and the attachment plate 1302, and the surface between the first bumper 1304 and the attachment plate 1302.

The exterior surface 1316 can extend across the attachment plate 1302, the first bumper 1304, and the second bumper 1308. The exterior surface 1316 further covers an outer surface of the flue protector 1300 from a front of the flue protector 1300 to a back of the flue protector 1300.

The attachment plate 1302 is depicted to have mounting tabs and securing pinholes, each of which fix the attachment plate 1302 tightly to the upright column 202 of FIG. 2, ensuring the flue protector 1300 is not bent or distorted.

More particularly, the attachment plate 1302 can include top tabs 1320 and bottom tabs 1322 with pinholes 1324 above both.

The top tabs 1320 can be arranged in a row with one of the top tabs 1320 near the left side 1306 of the attachment plate 1302 and the other top tab 1320 near the right side 1310 of the attachment plate 1302. Similarly, the bottom tabs 1322 can be arranged in a row with one of the bottom tabs 1322 near the left side 1306 of the attachment plate 1302 and the other bottom tab 1322 near the right side 1310 of the attachment plate 1302.

The pinholes 1324 can be positioned vertically in line with the tabs. That is, one of the pinholes 1324 could be above and inline with the top tab 1320 on the right side 1310 and the bottom tab 1322 on the right side 1310 while the other pinhole 1324 could be above and inline with the top tab 1320 on the left side 1306 and the bottom tab 1322 on the left side 1306.

The tabs themselves can be formed to extend inward from the exterior surface 1316 and past the interior surface 1318 of the attachment plate 1302. The tabs can couple with tab-holes (not shown) in the upright columns 202 of storage racks 204, both of FIG. 2.

The tabs can fix the attachment plate 1302 to the upright columns 202 of storage racks 204 without the use of tools. The pinholes 1324 within the attachment plate 1302 are configured align with rack pinholes (not shown) to fix the attachment plate 1302 to the upright column 202 with the use of the j-type drop pins 210 of FIG. 2.

The first bumper 1304 is extended to form an obtuse angle with the attachment plate 1302. The second bumper 1308 is also extended to form an obtuse angle with the attachment plate 1302. An obtuse angle is to be understood as an angle of greater than ninety degrees and less than one hundred eighty degrees.

The first bumper 1304 can extend out away from the left side 1306 of the attachment plate 1302 with a first bumper front extension 1326, transition to a first bumper rounded end 1328, and terminate at a first bumper terminal surface 1330 at the end of a first bumper back extension 1332.

The second bumper 1308 can extend out away from the right side 1310 of the attachment plate 1302 with a second bumper front extension 1336, transition to a second bumper rounded end 1338, and terminate at a second bumper terminal surface 1340 at the end of a second bumper back extension 1342.

The first bumper front extension 1326 can be longer than the first bumper back extension 1332. Similarly, the second bumper front extension 1336 can be longer than the second bumper back extension 1342.

The first bumper rounded end 1328 and the second bumper rounded end 1338 can avoid any catch points and allow a pallet to slide against the first bumper 1304 and the second bumper 1308 as a guide. The first bumper terminal surface 1330 and the second bumper terminal surface 1340 can face in the direction of the attachment plate 1302 and can be three inches apart to allow for the upright column 202 to fit therebetween.

The first bumper 1304 and the second bumper 1308 can extend from opposite sides of the attachment plate 1302 and can define the flue space 220 of FIG. 2. The flue space 220 is clear vertical lines of sight within the storage racks 204.

The flue space 220 defined by both the first bumper 1304 and the second bumper 1308 can be transverse flue space 220 parallel to the direction of loading and perpendicular to the attachment plate 1302. The flue space 220 can extend from the termination of the first bumper rounded end 1328 to the left side 1306 of the attachment plate 1302, or further to the upright column 202, or even to the upright horizontal strut 214 of FIG. 2. The flue space 220 can also extend from the termination of the second bumper rounded end 1338 to the right side 1310 of the attachment plate 1302, or further to the upright column 202, or even to the upright horizontal strut 214.

As such, the flue protector 1300 provides the physical means of protection in the transverse flue space by installing the flue protector 1300 on the front upright column 202 of the storage rack 204. The flue protector 1300 can guide pallets onto the shelf while simultaneously provide three inches of flue space 220 on both sides of the upright column 202.

Flue protection requires only a single flue protector 1300 and can be installed easily without tools. Costs are reduced both by reducing installation and labor costs as well as with a massive reduction in the amount of material used in the flue protector 1300.

The flue protector 1300 uses significantly less material than systems that span the full length of the flue space 220 between upright columns since the flue protector 1300 only is attached to a single column.

Figure 14:
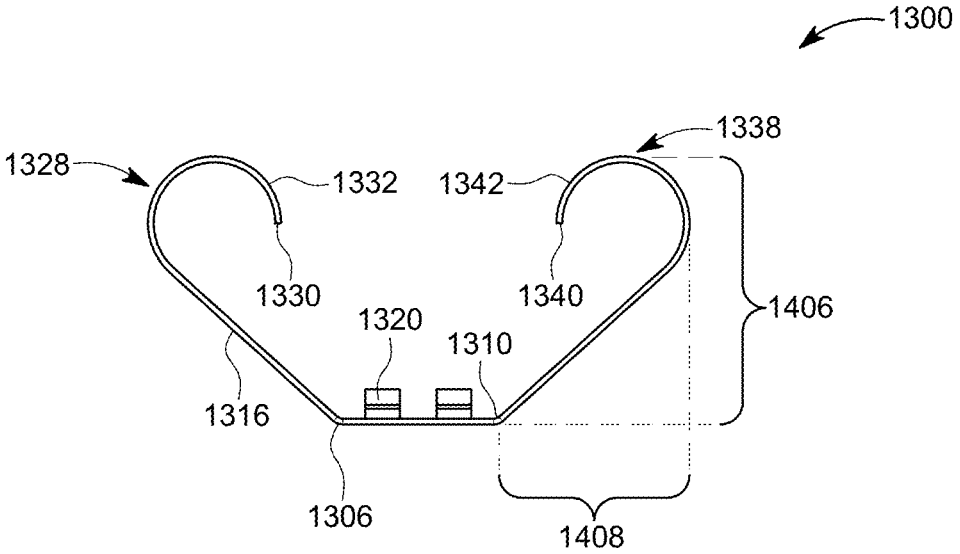
FIG. 14 is a top view of the flue protector of FIG. 13.

Referring now to FIG. 14, therein is shown a top view of the flue protector 1300 of FIG. 13. The flue protector 1300 is shown with a depth 1406, which can be the thickness of a bumper, either the first bumper 1304 or the second bumper 1308.

The depth 1406 can be measured between the exterior surface 1316 of a bumper front extension and the exterior surface 1316 of a bumper back extension. The depth 1406 can be 4.16 inches. The flue protector 1300 can further include a bumper width 1408, which can be the distance from the attachment plate 1302 to a bumper rounded end.

That is, the bumper width 1408 can be the distance from the right side 1310 of the attachment plate 1302 to the second bumper rounded end 1338 and can also be the distance from the left side 1306 of the attachment plate 1302 to the first bumper rounded end 1328. In the disclosed flue protector 1300 the bumper width 1408 can be three inches.

The first bumper terminal surface 1330, the first bumper back extension 1332, the second bumper terminal surface 1340, and the second bumper back extension 1342 can be in direct contact with the upright column 202 when installed. The top tabs 1320 are shown extending from the attachment plate 1302.

The top tabs 1320, the bottom tabs 1322 of FIG. 13, and the j-type drop pins 210 of FIG. 2 can be used without tools in a matter of seconds per mount. This has been discovered to be a large improvement over prior developments requiring multiple minutes to mount with tools. Furthermore, the flue protector 1300 can be mounted to the upright column 202 without unloading the storage rack 204 while prior developments did require the storage rack 204 to be unloaded as prior developments spanned between upright columns.

The flue protector 1300 can define the flue space 220 of FIG. 2 within the storage rack 204. The flue space 220 is clear vertical lines of sight within the storage racks 204.

The flue space 220 can extend from the termination of the first bumper rounded end 1328 to the left side 1306 of the attachment plate 1302 or further to the upright column 202 or even to the upright horizontal strut 214. The flue space 220 can also extend from the termination of the second bumper rounded end 1338 to right side 1310 of the attachment plate 1302 or further to the upright column 202 or even to the upright horizontal strut 214.

Figure 15:
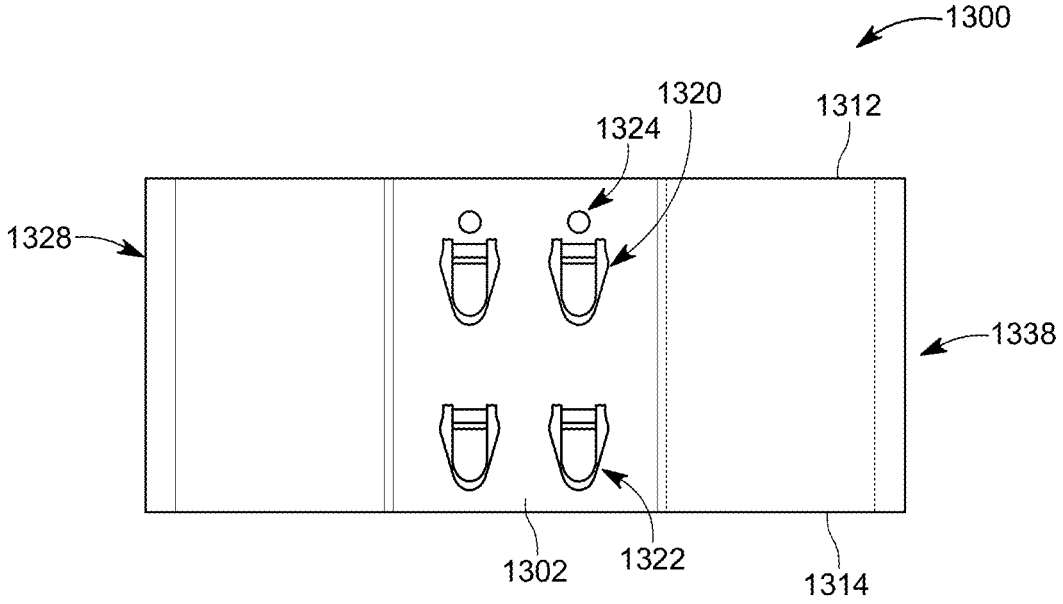
FIG. 15 is a front view of the flue protector of FIG. 13.

Referring now to FIG. 15, therein is shown a front view of the flue protector 1300 of FIG. 13. The flue protector 1300 can have a total width of 9.16 inches from the first bumper rounded end 1328 to the second bumper rounded end 1338.

The flue protector 1300 can have a total height of four inches from the top surface 1312 to the bottom surface 1314. Between the first bumper 1304 and the second bumper 1308, the flue protector 1300 is shown with the attachment plate 1302 having the top tabs 1320, the bottom tabs 1322, and the pinholes 1324 thereover.

Figure 16:
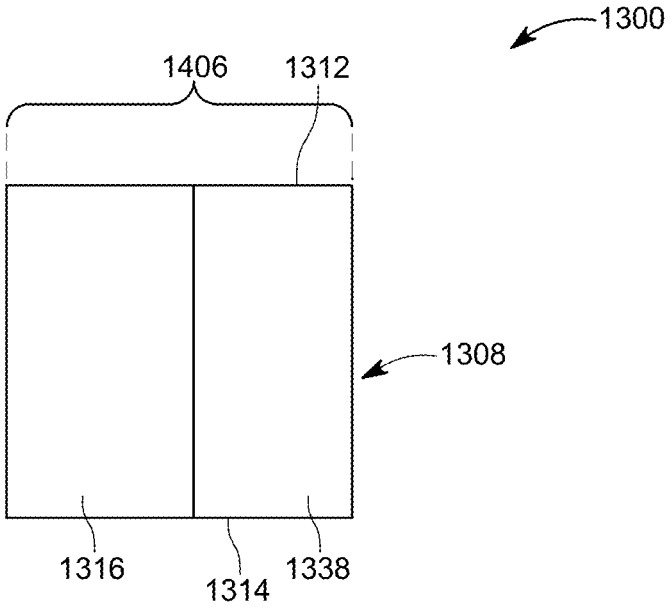
FIG. 16 is a right-side view of the flue protector of FIG. 13.

Referring now to FIG. 16, therein is shown a right-side view of the flue protector 1300 of FIG. 13. The exterior surface 1316 is shown defining the second bumper 1308 with the second bumper rounded end 1338. The second bumper 1308 is depicted having the depth 206 of 4.16 inches and a height of four inches between the top surface 1312 and the bottom surface 1314.

Figure 17:
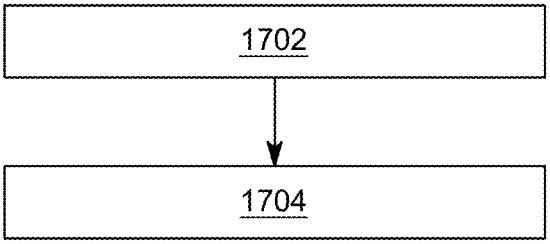
FIG. 17 is a flow chart for manufacturing the flue protector.

Referring now to FIG. 17, therein is shown a flow chart for manufacturing the flue protector system. The method of manufacturing the flue protector system can include: forming an attachment plate including a top tab, a bottom tab, and a pinhole, the top tab and the bottom tab configured to fix the attachment plate to an upright column without the use of a tool, the pinhole configured to fix the attachment plate to the upright column with the use of a j-type drop pin in a block 1702; and forming a bumper extended from the attachment plate, the bumper defines a flue space extending to the upright column.

Thus, it has been discovered that the flue protector furnishes important and heretofore unknown and unavailable solutions, capabilities, and functional aspects. The resulting configurations are straightforward, cost-effective, uncomplicated, highly versatile, accurate, sensitive, and effective, and can be implemented by adapting known components for ready, efficient, and economical manufacturing, application, and utilization.

While the flue protector has been described in conjunction with a specific best mode, it is to be understood that many alternatives, modifications, and variations will be apparent to those skilled in the art in light of the preceding description. Accordingly, it is intended to embrace all such alternatives, modifications, and variations, which fall within the scope of the included claims. All matters set forth herein or shown in the accompanying drawings are to be interpreted in an illustrative and non-limiting sense.

What is claimed is:

1. A flue protector system comprising:

an attachment plate including a tab configured to fix the attachment plate to an upright column without the use of a tool, the attachment plate having a flat surface and the tab extends from the flat surface with a cutout between the attachment plate and the tab, the cutout shaped by round connections extending through the attachment plate and the round connections positioned laterally between the tab and the attachment plate and the round connections extending laterally away from the tab on two sides of the tab, the tab configured to extend from the attachment plate and through the upright column; and a bumper extended from the attachment plate, the bumper defines a flue space extending to the upright column.

2. The system of claim 1 wherein: the bumper is rounded to allow a pallet to slide against the bumper as a guide.

3. The system of claim 1 wherein: the bumper is extended to form an obtuse angle with the attachment plate.

4. The system of claim 1 wherein: the attachment plate and the bumper are comprised of steel.

5. The system of claim 1 further comprising: a second bumper extending from an opposite side of the attachment plate and the second bumper defining a second flue space extending to the upright column.

* * * * *